US012134957B2

(12) United States Patent
Stolboushkin et al.

(10) Patent No.: US 12,134,957 B2
(45) Date of Patent: Nov. 5, 2024

(54) PERFORATION AND FRACTURE TOOL, SYSTEM AND METHOD

(71) Applicant: Baker Hughes Oilfield Operations LLC, Houston, TX (US)

(72) Inventors: Eugene Stolboushkin, Houston, TX (US); Aaron Young, Tomball, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 36 days.

(21) Appl. No.: 17/971,028

(22) Filed: Oct. 21, 2022

(65) Prior Publication Data

US 2024/0133274 A1 Apr. 25, 2024
US 2024/0229616 A9 Jul. 11, 2024

(51) Int. Cl.
*E21B 43/116* (2006.01)
*E21B 43/26* (2006.01)

(52) U.S. Cl.
CPC ..... *E21B 43/116* (2013.01); *E21B 43/26* (2013.01)

(58) Field of Classification Search
CPC ..... E21B 43/116; E21B 43/26
USPC ..... 166/297
See application file for complete search history.

(56) References Cited

U.S. PATENT DOCUMENTS

| | | | | |
|---|---|---|---|---|
| 5,669,448 | A * | 9/1997 | Minthorn | E21B 33/12 166/308.1 |
| 2009/0223659 | A1* | 9/2009 | Hill | E21B 23/01 166/55.1 |
| 2010/0236781 | A1* | 9/2010 | Mytopher | E21B 43/11852 166/55 |
| 2012/0199352 | A1* | 8/2012 | Lanclos | E21B 43/1185 166/65.1 |
| 2015/0013965 | A1* | 1/2015 | Cox | E21B 33/129 166/192 |
| 2017/0321506 | A1* | 11/2017 | Xu | E21B 43/26 |
| 2018/0155996 | A1* | 6/2018 | Ewing | E21B 23/04 |
| 2019/0284889 | A1* | 9/2019 | Lagrange | E21B 47/04 |
| 2020/0277837 | A1* | 9/2020 | Hern | E21B 23/0417 |
| 2021/0032955 | A1* | 2/2021 | Zakharia | E21B 33/127 |
| 2022/0003066 | A1* | 1/2022 | Hartman | E21B 17/028 |
| 2022/0268119 | A1* | 8/2022 | Jiang | C22C 1/026 |
| 2023/0003106 | A1* | 1/2023 | Conzemius | E21B 43/119 |

* cited by examiner

*Primary Examiner* — Taras P Bemko
(74) *Attorney, Agent, or Firm* — CANTOR COLBURN LLP

(57) ABSTRACT

A perforation and fracture tool including a perforating gun, a cone mandrel operatively connected to the gun, a slip operatively connected to the cone mandrel, and a seal element between the gun and the slip. A method for perforating and fracturing including initiating a perforation gun, driving a cone mandrel with evolved gas from the initiation, setting a seal, and pressuring against the seal to a fracture pressure. A borehole system including a borehole in a subsurface formation, a string in the borehole, and a perforation and fracture tool disposed within or as a part of the string.

19 Claims, 11 Drawing Sheets

PERFORATION AND FRACTURE TOOL, SYSTEM AND METHOD

BACKGROUND

In the resource recovery and fluid sequestration industries there is in the ordinary course a need to perforate casing in a borehole for resource production or fluid sequestration. Perforation of the casing provides access to a formation through which the borehole extends. A so-called Plug and Perf operation is known to the industry but while being effective, requires a number of steps that challenge efficiency. The art is always receptive to improvements in efficiency and reliability.

SUMMARY

An embodiment of a perforation and fracture tool including a perforating gun, a cone mandrel operatively connected to the gun, a slip operatively connected to the cone mandrel, and a seal element between the gun and the slip.

An embodiment of a method for perforating and fracturing including initiating a perforation gun, driving a cone mandrel with evolved gas from the initiation, setting a seal, and pressuring against the seal to a fracture pressure.

An embodiment of a borehole system including a borehole in a subsurface formation, a string in the borehole, and a perforation and fracture tool disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
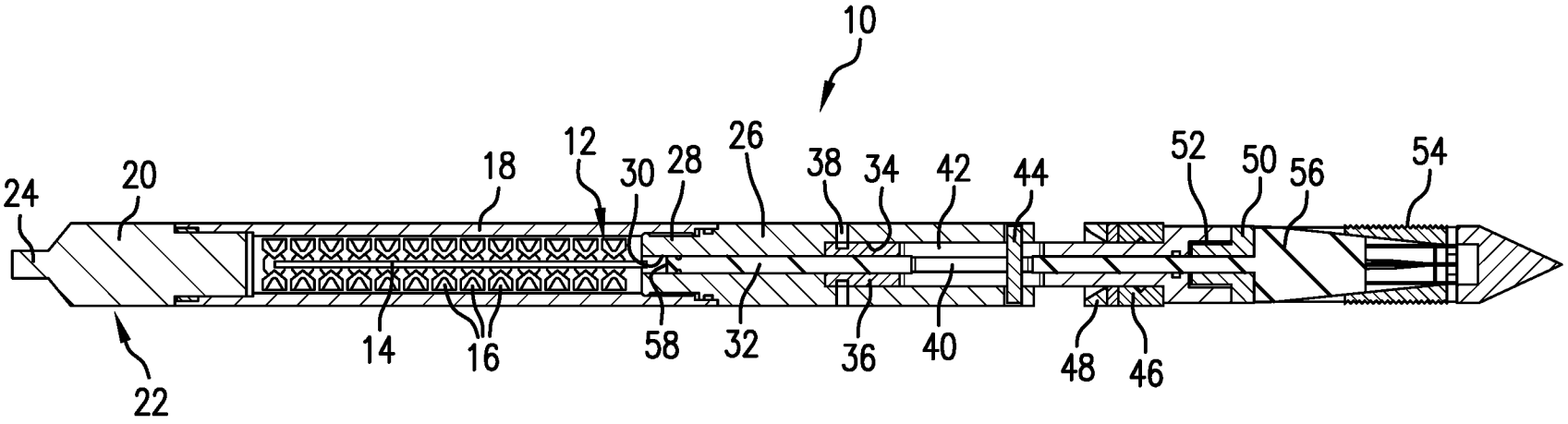
FIG. 1 is a cross sectional view of a perforation and fracture tool.
Figure 1A:
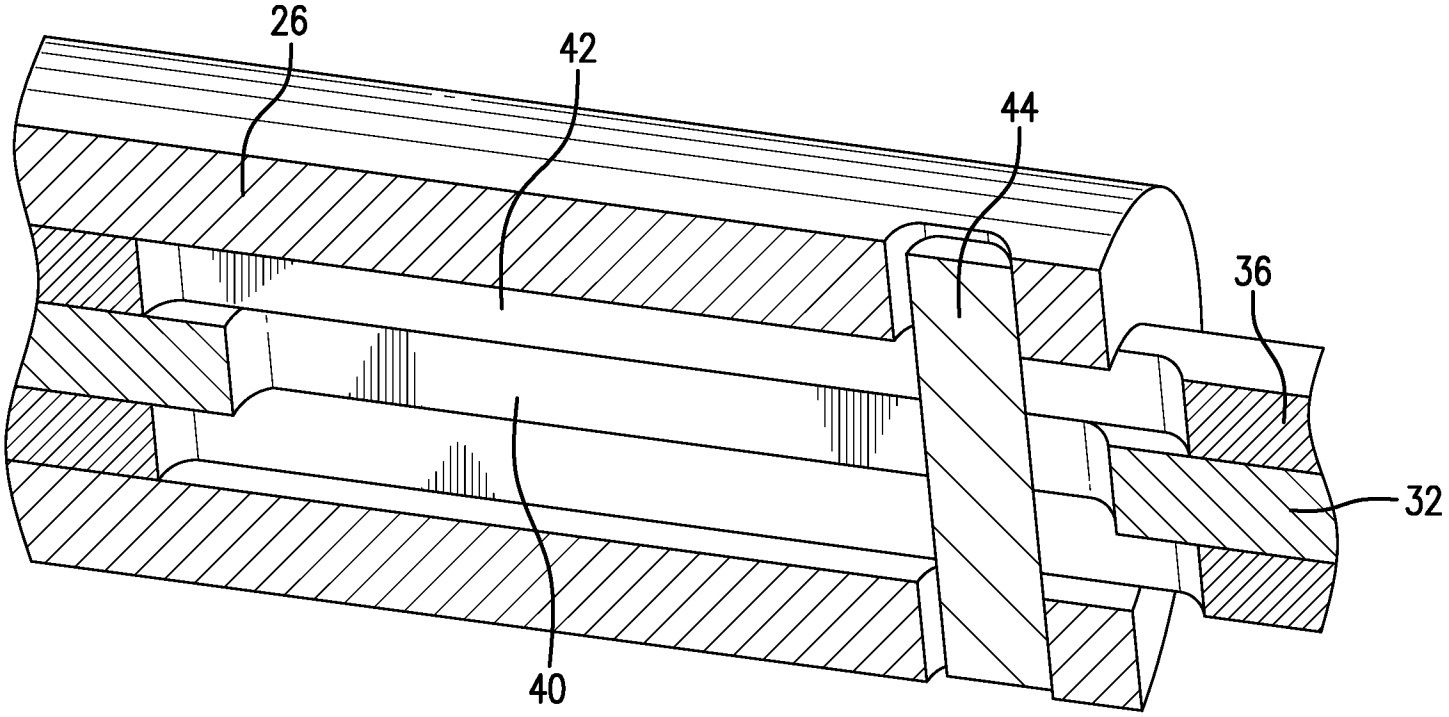
FIG. 1A is a perspective view of a portion of FIG. 1.
Figure 1B:
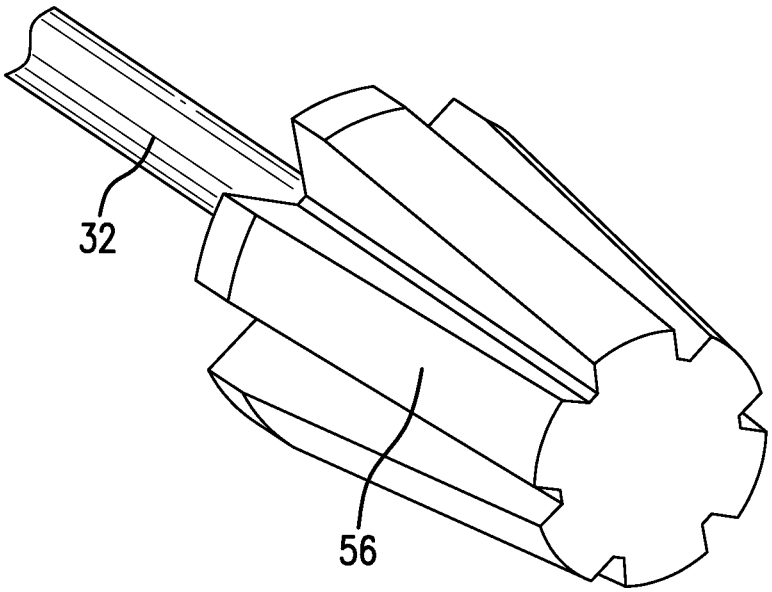
FIG. 1B is a perspective view of a portion of FIG. 1.

Referring to FIGS. 1, 1A and 1B, a perforation and fracture tool 10 includes a perforation gun 12 having a detonation (det) cord 14 and a plurality of shape charges 16. The charges 16 and det cord 14 are housed in gun housing 18. Triggering of the gun 12 is accomplished by a firing head 20 disposed within a connection sub 22. Connection sub 22 is configured to connect to a string 24 from a remote location such as a surface location. String 24 may be a wireline, slickline, coiled tubing, or jointed pipe in some embodiments. Housing 18 is fixedly connected to a top sub 26 at thread 28. Top sub 26 includes a bore 30, within which is slidably (telescopically) disposed a cone mandrel 32. The bore 30 and interior of the gun housing 18 are maintained at atmospheric pressure since that ensures the cone mandrel 32 will not actuate the slips prior to initiation of the gun 12. Top sub 26 also includes a partial bore 34, within which is disposed a seal mandrel 36. Seal mandrel 36 is initially fixed in the partial bore 34 with a releaser 38, such as a shear screw, for example. As is better understood hereunder during discussion of the retrieval process, the seal mandrel 36 becomes slidable in the top sub 26 upon sufficient tensile load on the releaser 38 to cause release thereof. The cone mandrel 32 includes a cone mandrel slot 40 and the seal mandrel includes a seal mandrel slot 42. Each of the slots provide for a working arrangement with regard to a key 44 affixed to the top sub 26. Upon the seal mandrel 36 is a seal 46 and in some embodiments also a swab cup 48. Seal mandrel 36 is further fixedly attached to a cage 50 at thread 52. The cage 50 supports and guides one or more slips 54 when being radially outwardly driven by cone 56 during a setting operation. The slips 54 may also be automatically retractable by an automatic retractor, such as, for example, a garter spring as is known in the art. Other automatic retraction configurations are also contemplated.

Figure 2:
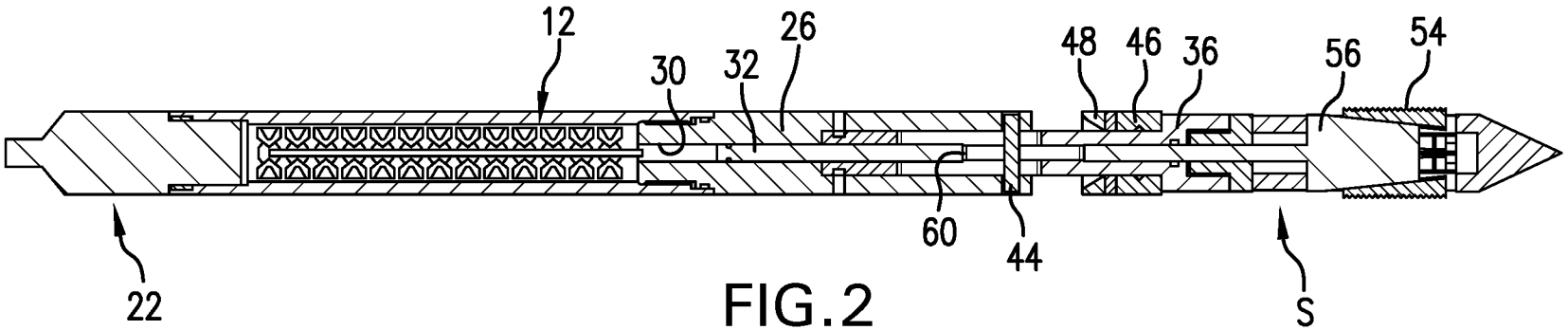
FIGS. 2-4 are the tool of FIG. 1 in progressive stages of setting.

The perforation gun 12 is fluidly connected to the bore 30 such that gas evolved by initiating the det cord 14 and charges 16 pressurizes the bore 30. In pressurizing the bore 30 the gas acts on an end 58 of cone mandrel 32. Resulting from this pressurization, and referring to FIG. 2, the cone mandrel 32 is moved relative to the top sub 26. Recall that in the initial condition, only the mandrel 32 will move while all other identified components will remain stationary. This means that the cage 50 remains in place while cone 56 is forced under the slips with the movement of the cone mandrel 32. This action causes perforation of a tubular form radially outwardly of the gun 12 and also causes the slips to set against that same tubular form. The time frame from when the perforation occurs to the setting of the slip occurs very short, e.g. under a second, in one example. Once the slip 54 is set, the tool 10 is anchored in place.

Figure 5:
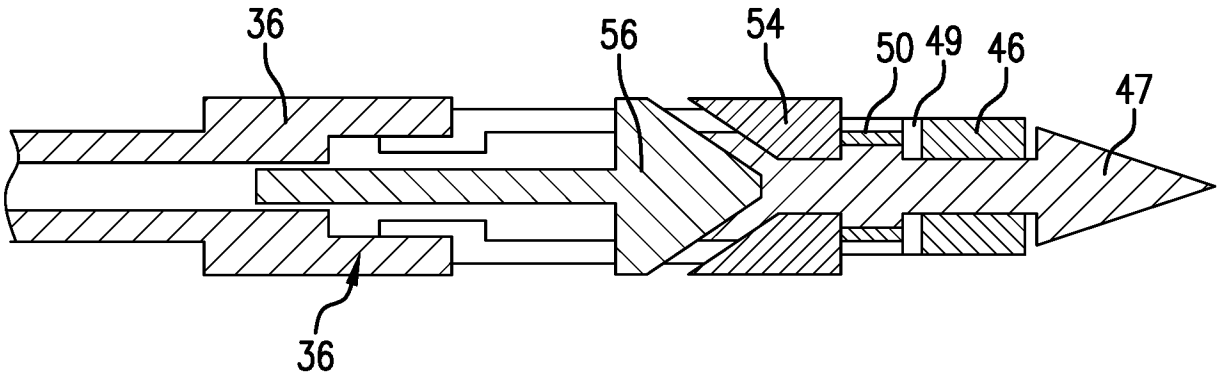
FIG. 5 is a sectional view of an alternate embodiment of the perforation and fracture tool disclosed herein.

After anchoring the tool 10 in place, pumps may be caused to flow fluid to the tool 10. Whether by fluidic friction on the seal or with assistance from a swab cup 48, the seal 46 is energized against the tubular form (see FIG. 3). In embodiments, the seal 46 is a compression packer. It is contemplated, however, that other types of seals cold be substituted such as swellable seals, inflatable seals, shape memory seals, etc. In another embodiment that does not require fluid flowing to set the seal, the seal 46 is set by the evolved gases just as the slip is set. This alternative is illustrated in FIG. 5. It will be appreciated that the seal 46 has been moved from the position it held in the FIG. 1 embodiment to a position between a cage end 47 and the slip 54. In this embodiment, the movement of the slip 54 due to evolved gas is also physically communicated to the seal 46 by physical contact between the slip 54 and a packer ring 49. When the slip is urged to the set position it also pinches the seal 46 between the cage end 47 and the packer ring 49. In other respects, this embodiment works as does the FIG. 1 embodiment. In this embodiment, setting of the seal 46 occurs at the same time as the slip and based upon the same force generated by the evolved gas.

Figure 3:
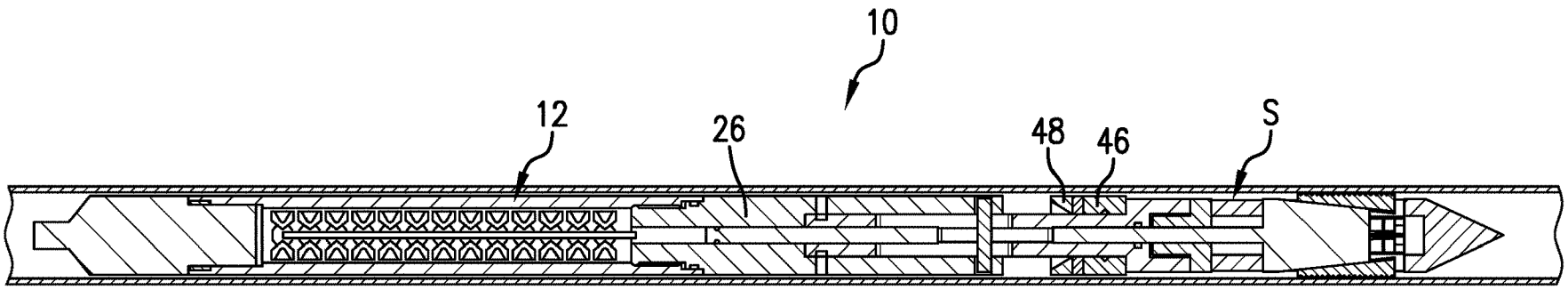
Figure 4:
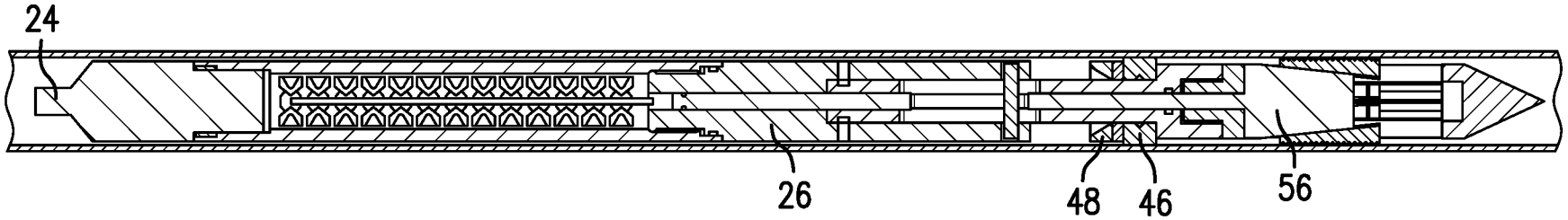

While pumping, the pressure against the seal 46 will rise as the seal becomes fully set, see FIG. 4, and will continue to rise until fracture of a surrounding formation is achieved. It is noted that in some embodiments, a stroke length of tool 10 is adjusted to ensure that while the seal is being set, the gun is moved toward the slip 54 so that the gun is not in line with the perforations during the high-pressure fracturing operation. This reduces damage to the tool 10 from flowing fluid and reduces the chances that sand bridging might occur through the perforations. Sand bridges are contraindicated because they tend to make the tool 10 much more difficult to retrieve. Stroking of the tool 10 can be accomplished in an embodiment by building stroke length into the cage 50. Referring to FIGS. 3 and 4 together, it is easy to appreciate the stroke that occurs along cage 50 at stroke area S in FIG. 3 that is shifted in FIG. 4 (shifted to downhole of the slip 54). The shouldering of the cage 50 on cone 56 provides for a strong base against which the seal 46 may be compressed, and transfers hydraulic load into the slips, securing the anchoring mechanism, and resisting motion from the hydraulic load.

Figure 6:
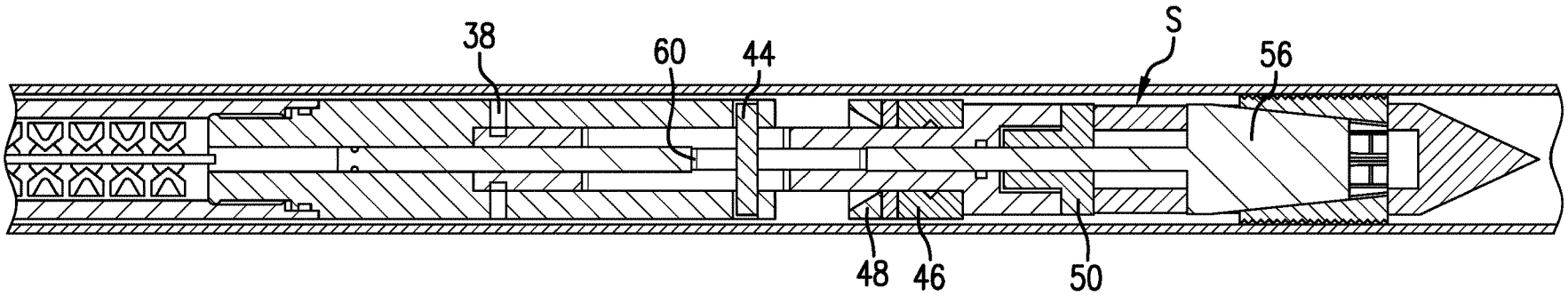
FIGS. 6-8 are the tool of FIG. 1 in progressive stages of unsetting.
Figure 7:
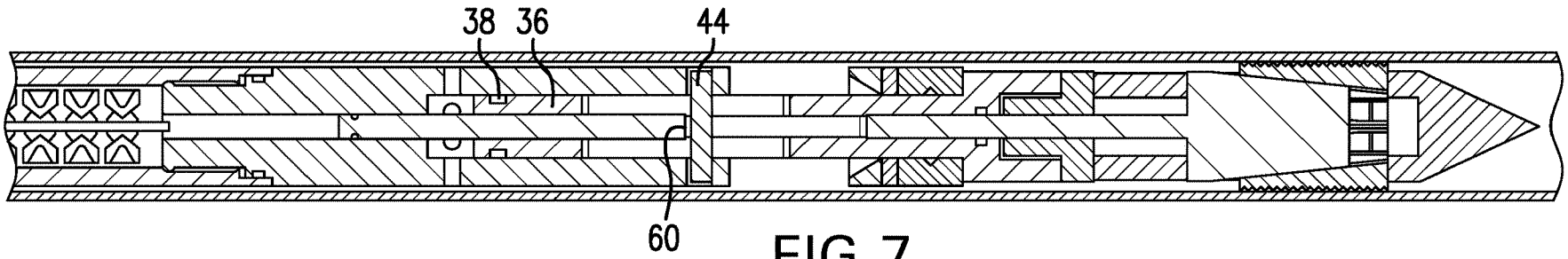
Figure 8:
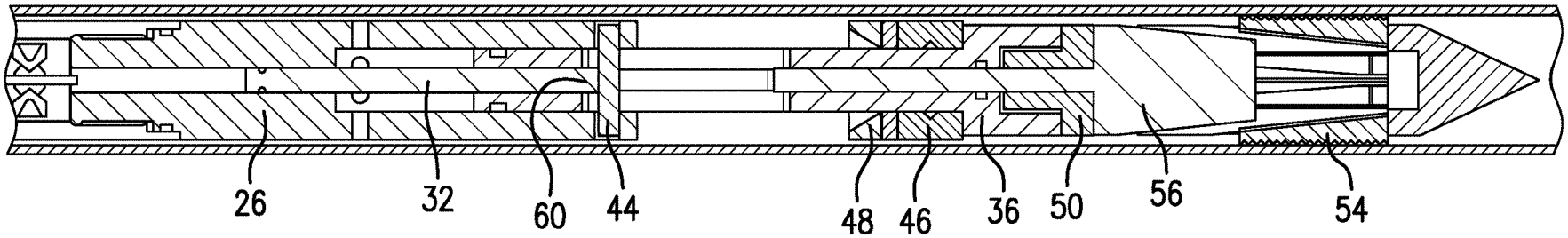

Referring to FIGS. 6-8, the unsetting sequence is illustrated. Overpull on string 24 is transferred through gun 12 to top sub 26 and those two parts will move in an uphole direction. Without the fluid flow pressure from pumps, the seal 46 will tend to relax on its own and become unset. Continued overpull unstrokes the tool 10 such that the stroke area S can be seen again in FIG. 6. Further overpull loads the releaser 38 causing release thereof and movement of top sub 26 in the uphole direction sliding off seal mandrel 36 to a degree (see FIG. 7). This results in the key 44 translating in the slot 40 of cone mandrel 32 until the key 44 makes contact with an uphole edge 60 of slot 40. At this point, the overpull transmitted through the gun 12 and the top sub 26 is also transmitted to the cone mandrel 32 through edge 60. Tension in this condition pulls the cone 56 out from under the slips, thereby unsupporting the slips 54 (see FIG. 8). In the condition of FIG. 8, the tool 10 may be tripped back to surface for a replacement of the perforation gun 12 and the det cord 14 and then tripping back downhole to the next target zone. Because of the unsettability of the tool 10 simply upon application of tension, the tool 10 is runnable on wireline, slickline or coiled tubing which improves speed and cost effectiveness of perforation and fracturing operations but could also be run on jointed pipe.

Figure 9:
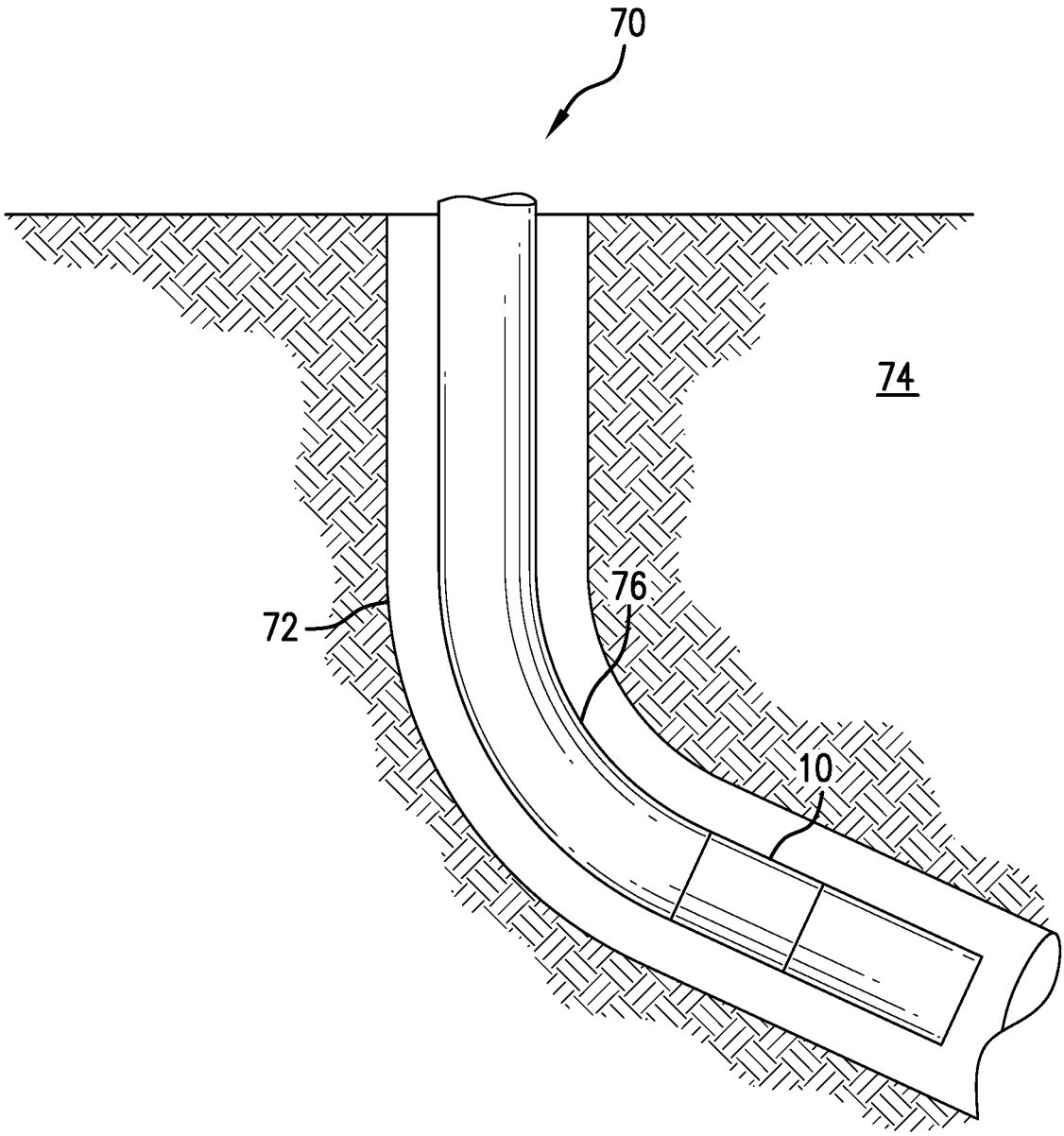
FIG. 9 is a view of a borehole system including the perforation and fracture tool as disclosed herein.

Referring FIG. 9, a borehole system 70 is illustrated. The system 70 comprises a borehole 72 in a subsurface formation 74. A casing string 76 is disposed within the borehole 72. A tool 10 as disclosed herein is disposed within the string 76.

Set forth below are some embodiments of the foregoing disclosure:

Embodiment 1: A perforation and fracture tool including a perforating gun, a cone mandrel operatively connected to the gun, a slip operatively connected to the cone mandrel, and a seal element between the gun and the slip.

Embodiment 2: The tool as in any prior embodiment, further comprising a running sub connectable to wireline, slickline, coiled tubing, or jointed pipe.

Embodiment 3: The tool as in any prior embodiment, wherein the running sub includes a firing head.

Embodiment 4: The tool as in any prior embodiment, wherein the cone mandrel is configured to be responsive to evolved gas in the gun.

Embodiment 5: The tool as in any prior embodiment, wherein upon gun initiation, the cone mandrel is driven by evolved gas into the slip causing setting of the slip.

Embodiment 6: The tool as in any prior embodiment, further comprising a slip cage supportive of the slip and receptive to the cone mandrel.

Embodiment 7: The tool as in any prior embodiment, wherein the cone mandrel includes longitudinal grooves therein that nest with the cage.

Embodiment 8: The tool as in any prior embodiment, further comprising a seal mandrel, the seal mandrel telescopically movable relative to the cone mandrel.

Embodiment 9: The tool as in any prior embodiment, further comprising a top sub attached to the gun.

Embodiment 10: The tool as in any prior embodiment, wherein the top sub includes a key that is interactive with the cone mandrel.

Embodiment 11: A method for perforating and fracturing including initiating a perforation gun, driving a cone mandrel with evolved gas from the initiation, setting a seal, and pressuring against the seal to a fracture pressure.

Embodiment 12: The method as in any prior embodiment, further including setting a slip.

Embodiment 13: The method as in any prior embodiment, wherein the setting the seal and setting the slip occur simultaneously.

Embodiment 14: The method as in any prior embodiment, wherein the setting the seal and setting the slip occur independently.

Embodiment 15: The method as in any prior embodiment, wherein the setting is by driving the seal with the evolved gas.

Embodiment 16: The method as in any prior embodiment, wherein the setting includes compressing the seal with the pressuring.

Embodiment 17: The method as in any prior embodiment, wherein the setting further includes stroking the gun after initiating the gun to displace the gun from a location of perforations.

Embodiment 18: The method as in any prior embodiment, further comprising unsetting the seal and unsetting a slip that is in contact with the cone mandrel by imparting a tensile load to the cone mandrel.

Embodiment 19: The method as in any prior embodiment, further comprising unsetting the seal by undoing the setting of the seal.

Embodiment 20: A borehole system including a borehole in a subsurface formation, a string in the borehole, and a perforation and fracture tool as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A perforation and fracture tool comprising:

a perforating gun;

a cone mandrel having an end fluidically connected to the gun;

a slip operatively connected to the cone mandrel, the cone mandrel configured only to respond to evolved gasses from ignition of the gun acting on the end of the cone mandrel to actuate the slip, without a setting tool, during use; and a seal element between the gun and the slip.

2. The tool as claimed in claim 1, further comprising a running sub connectable to wireline, slickline, coiled tubing, or jointed pipe.

3. The tool as claimed in claim 2, wherein the running sub includes a firing head.

4. The tool as claimed in claim 1, wherein upon gun initiation, the cone mandrel is driven by evolved gas into the slip causing setting of the slip.

5. The tool as claimed in claim 1, further comprising a slip cage supportive of the slip and receptive to the cone mandrel.

6. The tool as claimed in claim 5, wherein the cone mandrel includes longitudinal grooves therein that nest with the cage.

7. The tool as claimed in claim 1, further comprising a seal mandrel, the seal mandrel telescopically movable relative to the cone mandrel.

8. The tool as claimed in claim 1, further comprising a top sub attached to the gun.

9. The tool as claimed in claim 8, wherein the top sub includes a key that is interactive with the cone mandrel.

10. A borehole system comprising:

a borehole in a subsurface formation;

a string in the borehole; and a perforation and fracture tool as claimed in claim 1 disposed within or as a part of the string.

11. A method for perforating and fracturing comprising:

initiating a perforation gun;

driving a cone mandrel with evolved gas only from the initiation by directing the evolved gas to an end of the cone mandrel;

setting a seal; and pressuring against the seal to a fracture pressure.

12. The method as claimed in claim 11, further including setting a slip.

13. The method as claimed in claim 11, wherein the setting the seal and setting the slip occur simultaneously.

14. The method as claimed in claim 11, wherein the setting the seal and setting the slip occur independently.

15. The method as claimed in claim 11, wherein the setting is by driving the seal with the evolved gas.

16. The method as claimed in claim 11, wherein the setting includes compressing the seal with the pressuring.

17. The method as claimed in claim 11, wherein the setting further includes stroking the gun after initiating the gun to displace the gun from a location of perforations.

18. The method as claimed in claim 11, further comprising unsetting the seal and unsetting a slip that is in contact with the cone mandrel by imparting a tensile load to the cone mandrel.

19. The method as claimed in claim 11, further comprising unsetting the seal by undoing the setting of the seal.

* * * * *